US011350764B2

(12) United States Patent
Ward

(10) Patent No.: US 11,350,764 B2
(45) Date of Patent: Jun. 7, 2022

(54) BABY CARE SYSTEM AND METHODS OF ASSEMBLING

(71) Applicant: Jermaine L. Ward, Springfield, IL (US)

(72) Inventor: Jermaine L. Ward, Springfield, IL (US)

(73) Assignee: Jermaine L. Ward, Springfield, IL (US)

( * ) Notice: Subject to any disclaimer, the term of this patent is extended or adjusted under 35 U.S.C. 154(b) by 113 days.

(21) Appl. No.: 15/968,451

(22) Filed: May 1, 2018

(65) Prior Publication Data

US 2018/0310723 A1 Nov. 1, 2018

Related U.S. Application Data

(60) Provisional application No. 62/602,578, filed on May 1, 2017.

(51) Int. Cl.

| | |
|---|---|
| ***A47D 7/00*** | (2006.01) |
| ***B65F 1/14*** | (2006.01) |
| ***A47D 5/00*** | (2006.01) |

(52) U.S. Cl.

CPC ..... *A47D 7/007* (2013.01); *A47D 5/00* (2013.01); *B65F 1/1426* (2013.01); *B65F 2240/132* (2013.01)

(58) Field of Classification Search

CPC ..... A47D 7/007; A47D 5/00; B65F 1/1426; B65F 2240/132; A47C 17/52

See application file for complete search history.

(56) References Cited

U.S. PATENT DOCUMENTS

| | | | | | |
|---|---|---|---|---|---|
| 1,391,462 | A * | 9/1921 | Robinson | A47D 7/007 | 5/2.1 |
| 2,637,045 | A * | 5/1953 | Staartjes | A47D 7/007 | 5/2.1 |
| 2,662,231 | A * | 12/1953 | King | A47D 7/007 | 5/2.1 |
| 2,754,524 | A * | 7/1956 | Densmore | A47D 7/007 | 5/2.1 |
| 2,787,007 | A * | 4/1957 | Erdkamp | A47D 7/007 | 5/2.1 |

(Continued)

FOREIGN PATENT DOCUMENTS

| | | | | |
|---|---|---|---|---|
| DE | 202013010062 U1 * | 1/2014 | ..... | A47D 7/007 |
| WO | WO-03009721 A2 * | 2/2003 | ..... | A47D 5/00 |

*Primary Examiner* — Robert G Santos
*Assistant Examiner* — Alison N Labarge
(74) *Attorney, Agent, or Firm* — Nixon Peabody LLP

(57) ABSTRACT

A compact baby care system includes a baby crib assembly, at least one sliding storage drawer, and at least one utility cabinet. The baby crib assembly includes a left side panel, an opposing right side panel, a bottom panel, and opposing top and bottom horizontal rails extending between the left side panel and the opposing right side panel. The bottom panel is horizontally secured between the left panel and the opposing right panel. The bottom panel is configured to support a mattress. The at least one sliding storage drawer is underneath the bottom panel of the baby crib assembly. The at least one utility cabinet is attached to the left side panel or the opposing right side panel of the baby crib assembly via a connector. The at least one utility cabinet stores at least one of a feeding station and a changing station.

20 Claims, 8 Drawing Sheets

(56) References Cited

U.S. PATENT DOCUMENTS

| | | | | |
|---|---|---|---|---|
| D187,257 | S * | 2/1960 | Hackett | D6/384 |
| D272,872 | S * | 3/1984 | Moreno | D6/384 |
| 4,717,214 | A | 1/1988 | Moore et al. | |
| 4,844,566 | A | 7/1989 | Moore et al. | |
| 5,148,561 | A | 9/1992 | Tharalson et al. | |
| 5,233,710 | A | 8/1993 | Bernard | |
| 5,277,472 | A | 1/1994 | Freese et al. | |
| 5,790,994 | A | 8/1998 | Leonard | |
| 6,052,853 | A | 4/2000 | Schmid | |
| 6,370,718 | B1 | 4/2002 | Schmid | |
| 6,592,425 | B2 | 7/2003 | Bapst et al. | |
| 7,665,162 | B2 * | 2/2010 | Peer | A47D 13/066 5/201 |
| 7,836,530 | B2 | 11/2010 | Thorne et al. | |
| 8,234,734 | B2 | 8/2012 | Perry | |
| 8,458,829 | B2 | 6/2013 | Thorne et al. | |
| 2005/0020180 | A1 * | 1/2005 | DiMambro | A47B 47/00 446/482 |
| 2005/0076438 | A1 | 4/2005 | Laguatan et al. | |
| 2009/0064409 | A1 * | 3/2009 | Carpenter | A47D 11/005 5/2.1 |
| 2010/0186169 | A1 | 7/2010 | Kelly et al. | |
| 2011/0031457 | A1 | 2/2011 | Thorne et al. | |
| 2013/0032611 | A1 * | 2/2013 | Dooley | A47J 31/401 222/129.4 |
| 2013/0239322 | A1 | 9/2013 | Thorne et al. | |
| 2015/0000034 | A1 | 1/2015 | Geng | |
| 2015/0076973 | A1 * | 3/2015 | Pierson | A47B 97/00 312/71 |
| 2016/0051430 | A1 | 2/2016 | Bader | |
| 2016/0066705 | A1 | 3/2016 | Yaacoby et al. | |
| 2016/0174700 | A1 | 6/2016 | Brandenberg | |
| 2016/0324331 | A1 | 11/2016 | Karavias | |

* cited by examiner

BABY CARE SYSTEM AND METHODS OF ASSEMBLING

CROSS-REFERENCE TO RELATED APPLICATIONS

This application claims priority to and the benefit of U.S. Provisional Patent Application No. 62/602,578, filed May 1, 2017, which is hereby incorporated by reference herein in its entirety.

FIELD OF THE INVENTION

The present disclosure relates generally to infant cribs, and more particularly to multipurpose-style baby care systems including a crib along with baby feeding and hygiene compartments.

BACKGROUND OF THE INVENTION

Slightly fewer than four million babies are born in the United States each year. Many parents are particularly concerned about every aspect of their baby's wellbeing as well as the convenience of caring for their newborn. Combination crib, small bathtub, and toilet unit systems are known in the field for the care of infants. However, there are limited crib systems that allow care givers to continually care for an infant while remaining within the same room or very close by to tend to the infant's needs.

It would be desirable to have a baby care system that allows parents and other care givers the convenience to continually tend to an infant under their care without having to leave the nursery where the infant is present.

SUMMARY OF THE INVENTION

According to some implementations of the present disclosure, a compact baby care system includes a baby crib assembly, at least one sliding storage drawer, and at least one utility cabinet. The baby crib assembly includes a left side panel, an opposing right side panel, a bottom panel, and opposing top and bottom horizontal rails extending between the left side panel and the opposing right side panel. The bottom panel is horizontally secured between the left panel and the opposing right panel. The bottom panel is configured to support a mattress. The opposing top and bottom horizontal rails having a plurality of horizontally spaced vertical slats extending from at least one top horizontal rail to at least one respective bottom horizontal rail. The at least one sliding storage drawer is underneath the bottom panel of the baby crib assembly. The at least one utility cabinet is attached to the left side panel or the opposing right side panel of the baby crib assembly via a connector. The at least one utility cabinet stores at least one of a feeding station and a changing station.

According to some implementations of the present disclosure, a method of assembling a compact baby care system includes providing a compact baby care system kit. The compact baby care system includes a combined baby crib and dresser unit, a baby changing utility cabinet, and a baby feeding utility cabinet. The combined baby crib and dresser unit includes opposing side panels and a plurality of wheels. A first panel of the opposing side panels supports a first portion of a first connector. A second panel of the opposing side panels supports a first portion of a second connector. The baby changing utility cabinet includes a first utility side panel and a plurality of wheels. The first utility side panel supports a second portion of the first connector. The baby feeding utility cabinet includes a second utility side panel and a plurality of wheels. The second utility side panel supports a second portion of the second connector. The baby changing utility cabinet connects to the combined baby crib and dresser unit via the first and second portions of the first connector. The baby feeding utility cabinet connects to the combined baby crib and dresser unit via the first and second portions of the second connector.

The foregoing and additional aspects and implementations of the present disclosure will be apparent to those of ordinary skill in the art in view of the detailed description of various embodiments and/or implementations, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

Figure 1A:
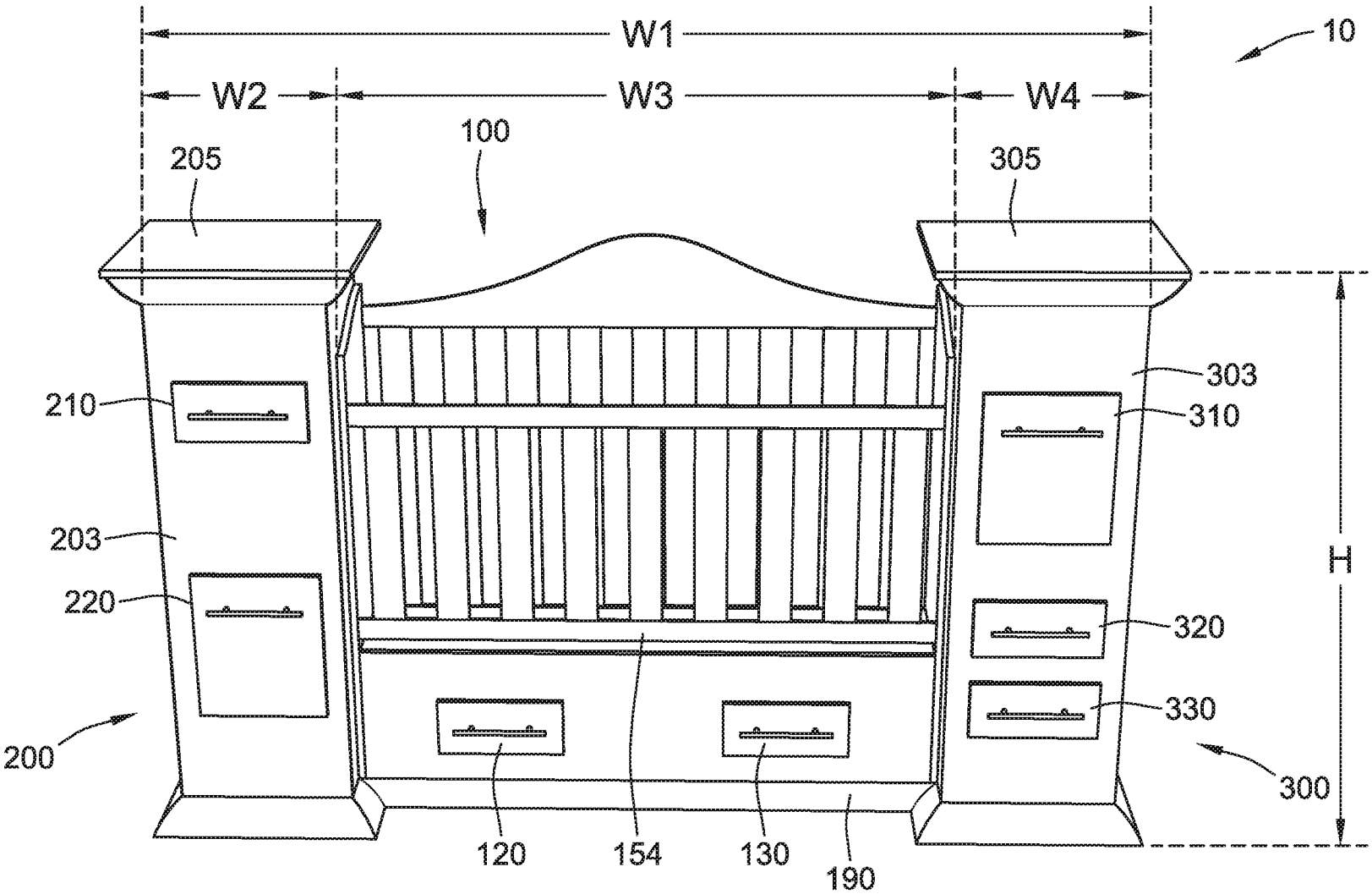
FIG. 1A is an exemplary perspective front view of a compact baby care system, according to some aspects of the present disclosure.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the present disclosure as defined by the appended claims.

DETAILED DESCRIPTION OF THE ILLUSTRATED EMBODIMENTS

While this present disclosure is susceptible of embodiment in many different forms, there is shown in the drawings and will herein be described in detail preferred embodiments of the present disclosure with the understanding that the present disclosure is to be considered as an exemplification of the principles of the present disclosure and is not intended to limit the broad aspect of the present disclosure to the embodiments illustrated. For purposes of the present detailed description, the singular may include the plural and vice versa (unless specifically disclaimed); the word "or" shall be both conjunctive and disjunctive; the word "all" means "any and all"; the word "any" means "any and all"; and the word "including" means "including without limitation."

According to some aspects of the present disclosure, an all-in-one baby station is described that provides a convenient, practical, multi-component system to meet the needs of a new parent. An all-in-one baby station can facilitate a baby care process for newborn babies that allows the care giver to remain in the room without having to leave or pick up the infant. Many new mothers find it challenging to tend to their babies, as the constant feeding and changing of diapers can be frustrating, such as when having to go outside the room where the aby is present to retrieve various feeding or cleaning supplies.

Aspects of the baby care system of the present disclosure provide ingenious, practical, and useful features including an all-in-one baby station including one or more of the following: a crib with incorporated drawers, a changing table or station, a dresser, a diaper disposal compartment, a feeding or milk dispenser compartment, and a baby hygiene compartment. This system can be a modular unit made of multiple modules that are attached to form a complete baby care system. Baby care systems, such as the ones described herein, provide numerous convenience options while allowing adequate storage space to keep all of the fundamental items needed to effectively take care of a new born baby without the need for a caregiver to leave the room.

In some aspects, a baby care system can include fitted drawers for storing baby food and wipes in addition to a separate diaper disposal holder and a separate milk dispenser holder. It is further contemplated that the baby care systems described herein may be constructed of solid wood for durability along with wheels for effortless portability. Other materials for constructing a baby care system are contemplated that provide similar durability and portability.

The advantages of the present disclosure include, without limitation, that it is a multipurpose crib allowing the user to address the needs of an infant at the same location as the unit. The said unit could offer versatility where groups of infants are being cared for as well as where a single infant is being cared for.

In certain aspects it is contemplated that the multipurpose crib or baby care system may be elevated above the ground on wheels for easy mobility. Variations in the shape, material, construction methods, and size of the baby care systems described herein are also contemplated, including variations to the base crib unit and the left or right compartments. Additional aspects include variations of many different holder features. For example, in one aspect the baby care system may include a holder for a traditional wipe warmer that allows a user to have a warmer rather than coil wipes.

Figure 1B:
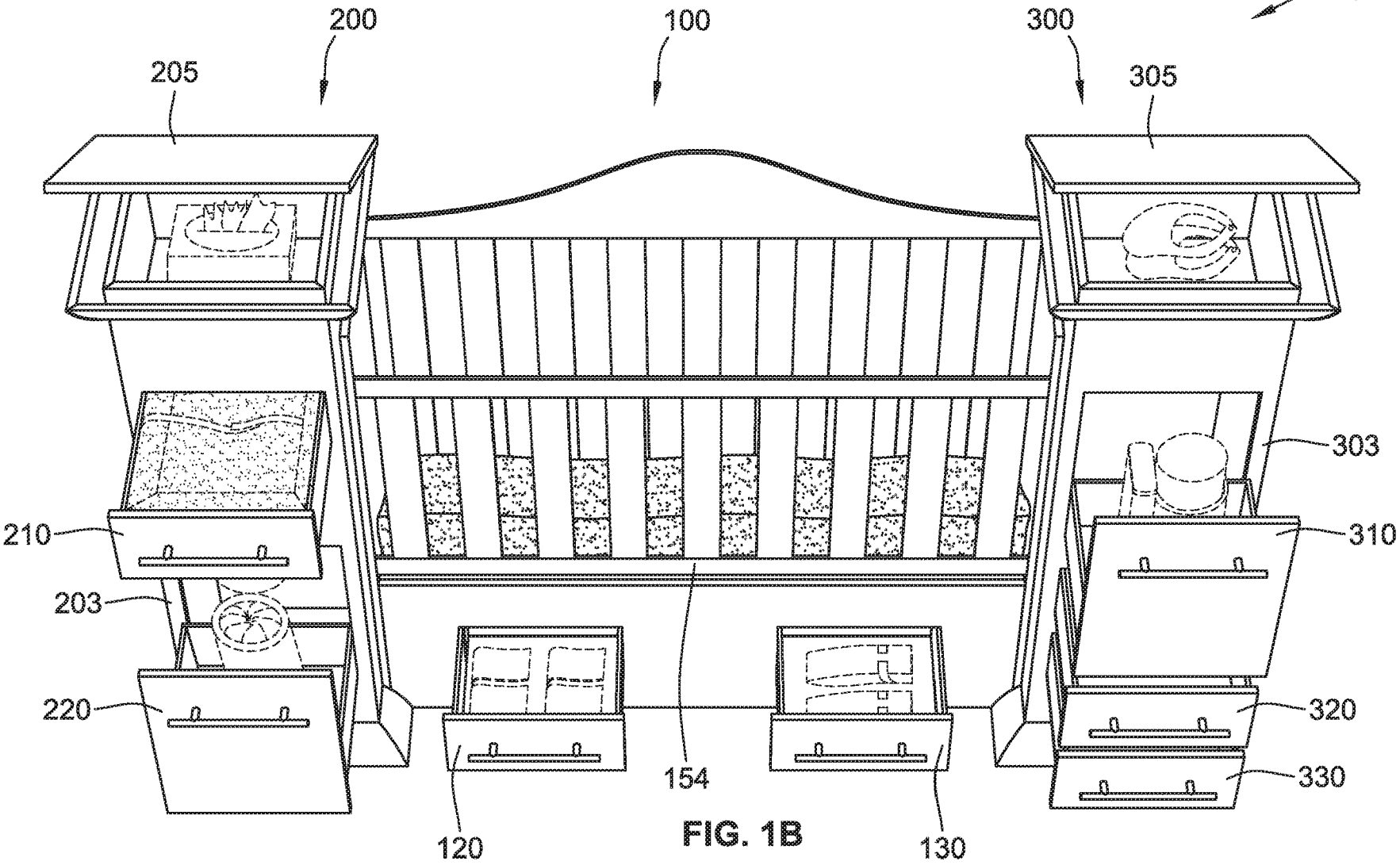
FIG. 1B is an exemplary perspective top view of the compact baby care system of FIG. 1A, according to some aspects of the present disclosure.
Figure 2:
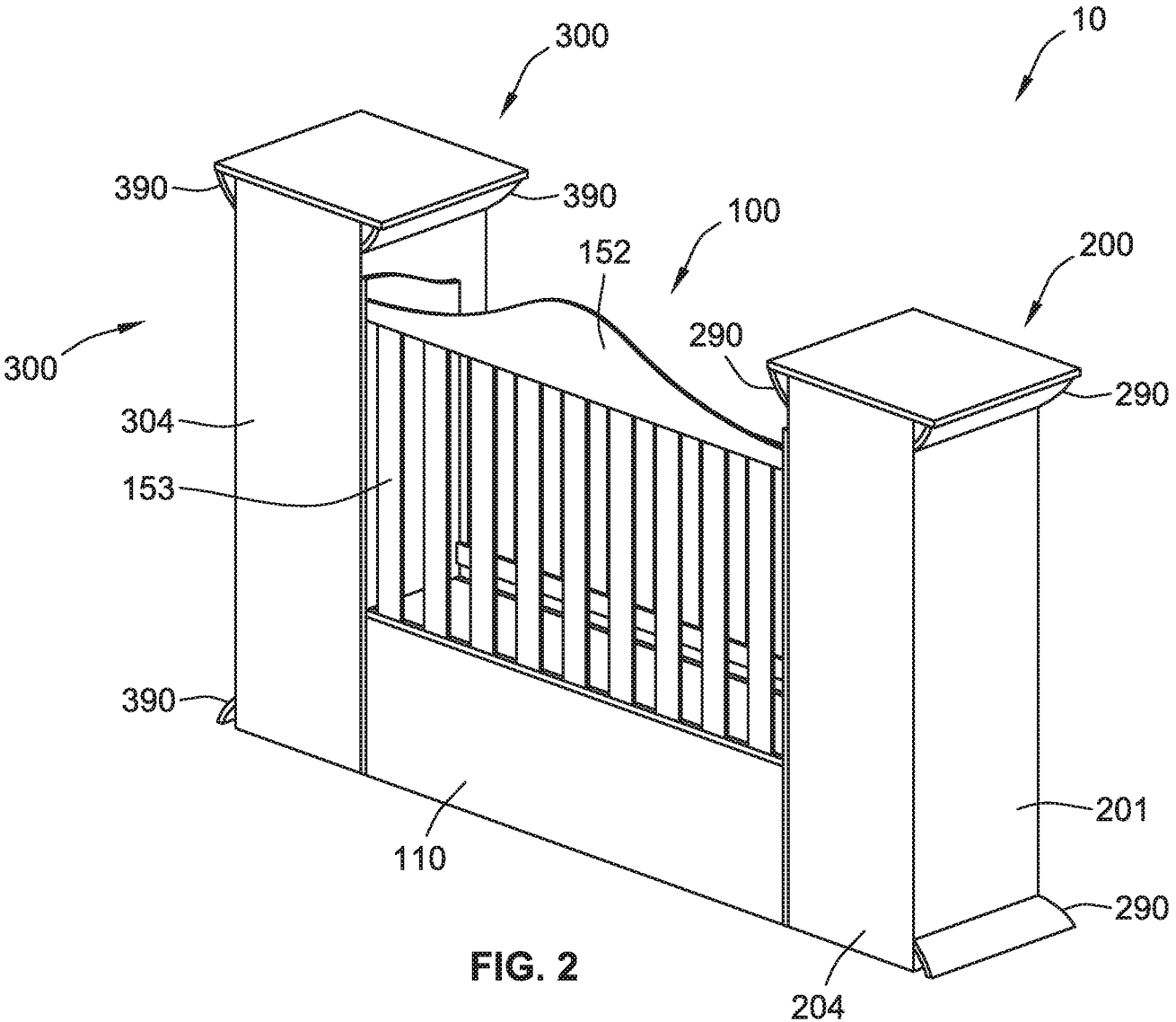
FIG. 2 is an exemplary perspective rear view of the compact baby care system of FIG. 1A, according to some aspects of the present disclosure.

Referring generally to FIGS. 1A, 1B and 2, a compact baby care system 10 may include a center cabinet assembly 100, one or more utility cabinets, for example, a left utility cabinet 200 and a right utility cabinet 300, with retrofitted drawers. In some implementations, the center cabinet assembly 100 may include a baby crib in the top portion and one or more sliding storage drawers, e.g., 120, 130, in the bottom portion. The left utility cabinet 200 may include a pull-out changing compartment 210 in the top portion and a pull-out diaper disposal compartment 220 in the bottom portion. The right utility cabinet 300 may include a pull-out bottle maker compartment 310 in the top portion and one or more sliding utility drawers, e.g., 320, 330, in the bottom portion.

Figure 3A:
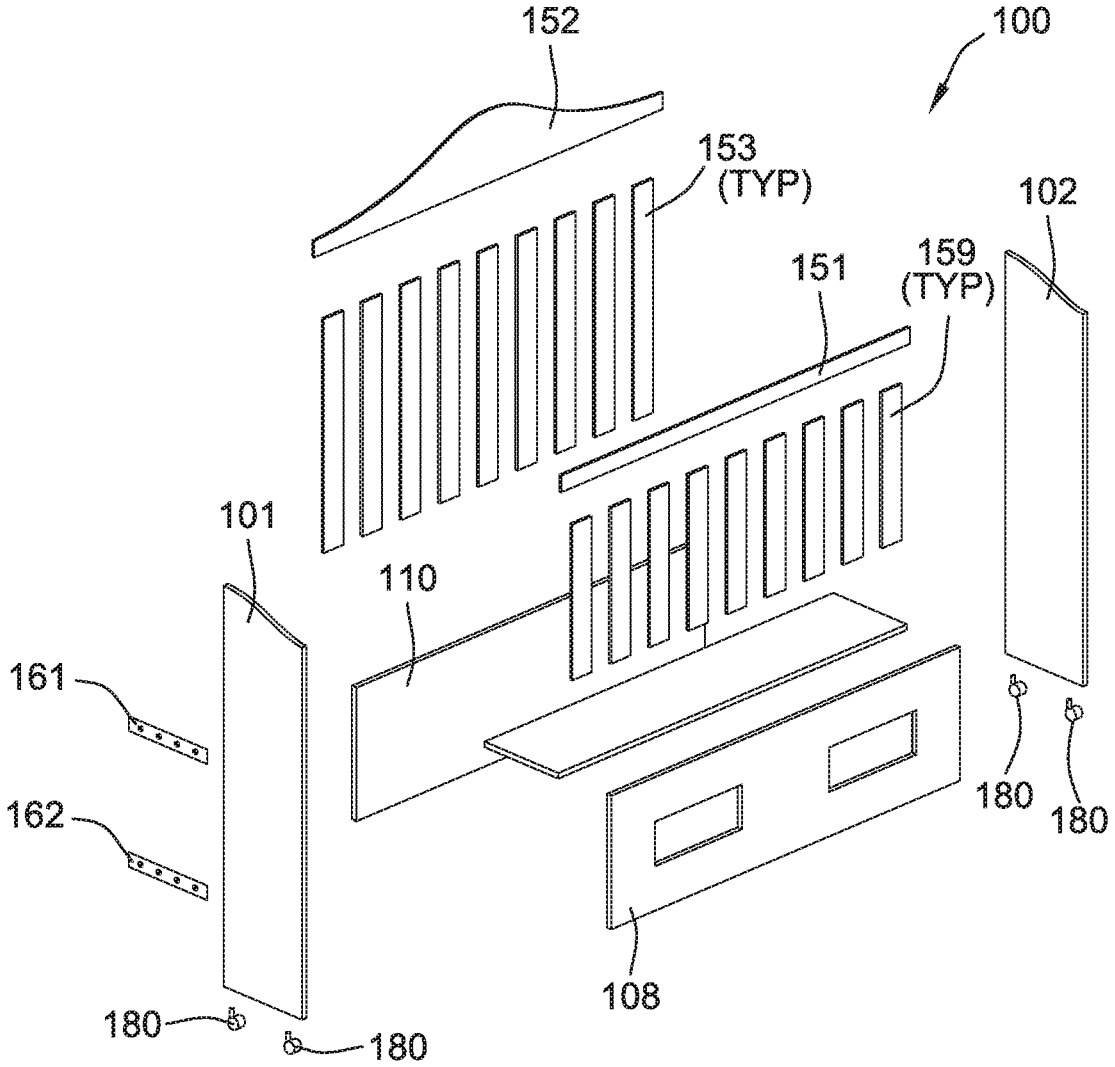
FIG. 3A is an exemplary exploded partial view of a center cabinet assembly of the compact baby care system of FIG. 1A, according to some aspects of the present disclosure.

Referring now to FIG. 3A, in some exemplary implementations, the center cabinet assembly 100 is a crib and dresser unit that may include a left side panel 101 and a right side panel 102. The side panels 101, 102 may be attached to opposing horizontal rail pieces 151, 152 at the top portion and opposing lower dresser pieces 108, 110 with dowel pins and wood glue or via other suitable attachments for a crib system. Evenly spaced back slats 153 are placed vertically between rail 151 and lower dresser piece 108 and between rail 152 and lower dresser piece 110. In one aspect, the horizontal spacing between the vertical slats is about two inches. The slats 153 are doweled to at least the rail pieces 151, 152 and the respective lower dresser pieces 108, 110. In some implementations, the lower dresser piece 108 operates as a bottom horizontal rail that vertically opposes the top horizontal rail piece 151. It is further contemplated that the lower dresser piece 110 can operate as a bottom horizontal rail that vertically opposes the top horizontal rail piece 152. Alternatively or in combination, opposing bottom horizontal rails can be supported by one or more of the lower dresser pieces 108, 110. An example of one of opposing bottom horizontal rails is shown in FIGS. 1A and 1B as horizontal rail 154.

A first pair of interlocking brackets 161, 162 may be attached to an outside facing surface of the left side panel 101. A second pair of interlocking brackets (not shown) may be attached to an outside facing surface of the right side panel 102. The interlocking brackets may extend or protrude from the outside surface of the side panels 101, 102 or may also be at least partially embedded below the outside surface of the side panels 101, 102. The interlocking brackets may be elongated brackets and may also expand across an entire width of the side panels such as from one edge of the panel to an opposing edge. Alternatively, the interlocking brackets may only expand across a portion of the width of the side panels. More or fewer interlocking brackets are also contemplated. The interlocking brackets may be made of plastic, metal, wood, or any other material commonly used in furniture.

Figure 3B:
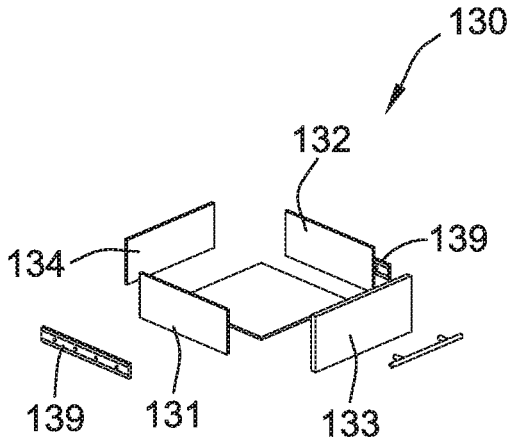
FIG. 3B is an exemplary exploded partial view of a sliding storage drawer of the center cabinet assembly of FIG. 3A, according to some aspects of the present disclosure.

The center cabinet assembly 100 may include at least one sliding storage drawer 130 in the dresser unit at the lower portion of the assembly. As shown for example in FIG. 3B, the sliding storage drawer 130 may include two side panels 131, 132. The two side panels 131, 132 may be attached to a front panel 133 and a back panel 134 with dowel pins and wood glue. In one aspect, the front panel 133 has a width of about nine inches. The sliding storage drawer 130 may be affixed to the center cabinet assembly 100 with drawer guides 139. More or fewer sliding storage drawers are also contemplated. For example, FIG. 1A illustrates two sliding storage drawers 120, 130.

The crib and dresser unit 100 may also include a plurality of fixed or removable wheels 180 for easy transportation. The wheels 180 may be attached to the center cabinet assembly 100 and be further capable of locking into position such that the center cabinet assembly cannot be moved or rolled on the supporting floor surface. Decorative trim 190 can be added to the base portion of the center cabinet assembly 100 with solid fasteners.

Figure 4A:
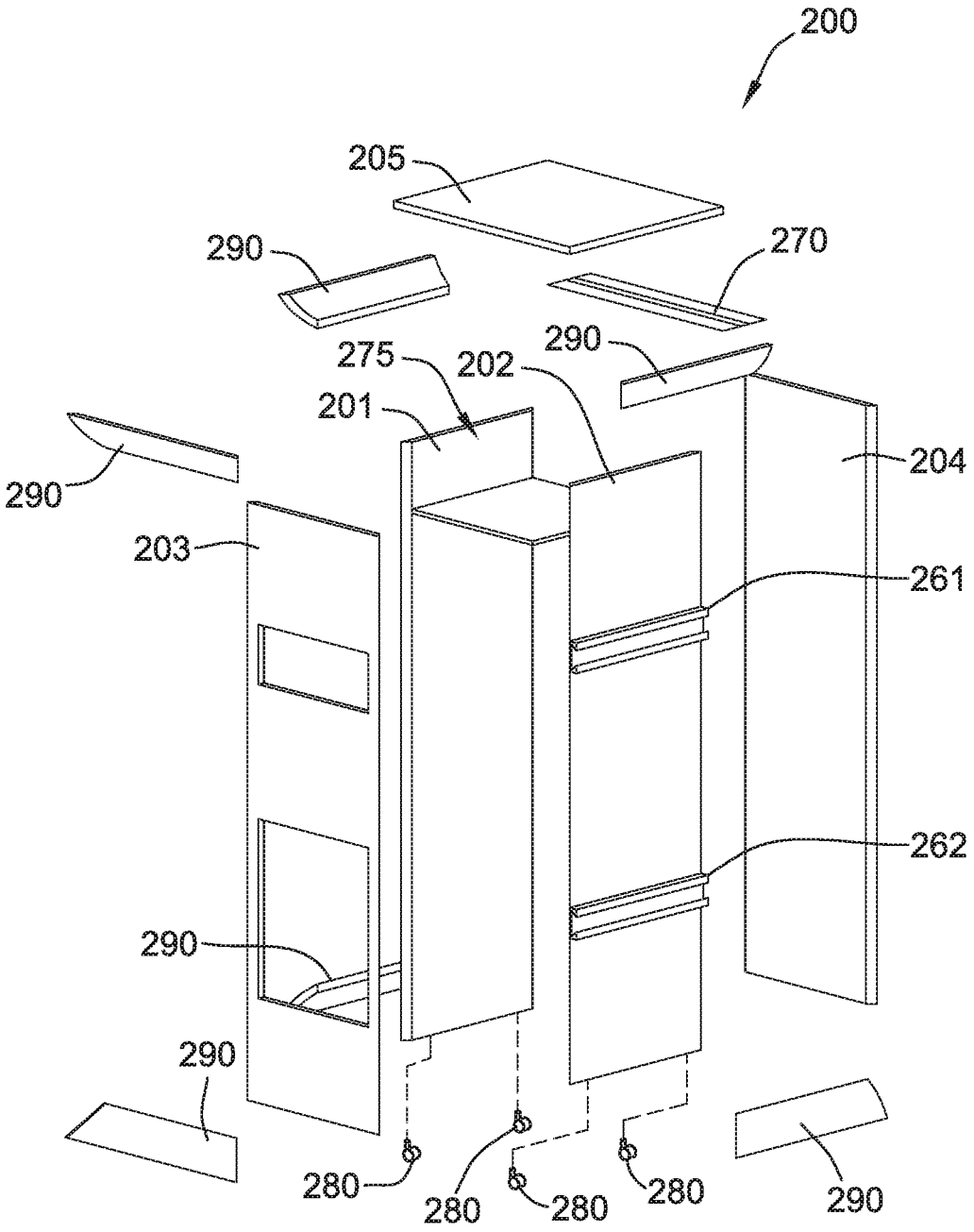
FIG. 4A is an exemplary exploded partial view of a first utility cabinet of the compact baby care system of FIG. 1A, according to some aspects of the present disclosure.

In some aspects, the first pair of interlocking brackets 161, 162 on the left side panel 101 of the crib and dresser unit of the center cabinet assembly 100 are used to engage a respective pair of channels 261, 262 on a right side panel 202 of the exemplary left utility cabinet 200 that is illustrated in FIG. 4A. The channels 261, 262 may be at least partially recessed below a surface of the side panel 202 that is exposed to the outside surface of the left side panel 101. In other aspects, the channels 261, 262 may be surface mounted. The channels 261, 262 can expand across an entire width of the right side panel 202 such as from one edge to an opposing edge. Alternatively, the channels 261, 262 may only expand across a portion of the width of the right side panel 202. In some implementations, the interlocking brackets may be formed on the right side panel 202 of the left utility cabinet 200, and the respective pair of channels, recessed or surface mounted, may be formed on the left side panel 101 of the crib and dresser unit or the center cabinet assembly 100. Other connection techniques may be used in place of the interlocking system described above for connecting the center cabinet assembly 100 and utility cabinet 200. For example, the left side panel 101 of the crib and dresser unit and the right side panel 202 of the left utility cabinet 200 may be mechanically joined at their interfaces by dowel and/or tongue and groove construction techniques, or any other mechanical systems for joining units of furniture, such as techniques utilizing fasteners, supports, glides, slides, and channels. Once joined or connected, the panels 101, 202 are flush with each other.

In some exemplary implementations, the left utility cabinet 200 also may include a left side panel 201 that is attached to a front panel 203 and a back panel 204 using dowel and wood glue. The left utility cabinet 200 further may include a top panel 205 that is attached to the left utility cabinet 200 with hinge assembly 270 where the top panel 205 could operate in some aspects as a lid that opens up, allowing additional storage space 275 or top access to left utility cabinet 200. The additional storage space 275 can be retrofitted with a wipe dispenser holder feature useful for baby hygiene.

Figure 4B:
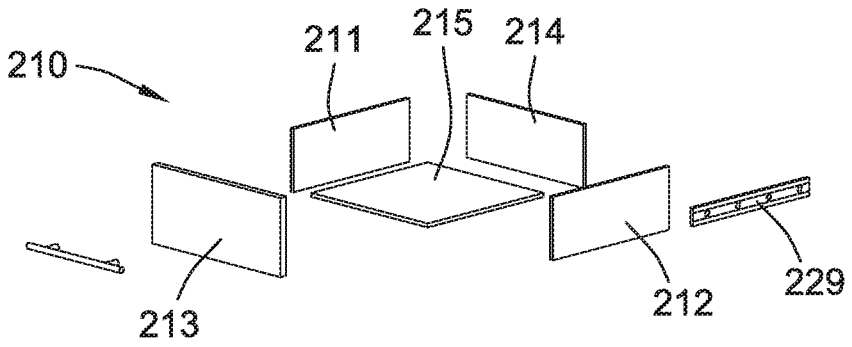
FIG. 4B is an exemplary exploded partial view of a pull-out changing compartment of the first utility cabinet of FIG. 4A, according to some aspects of the present disclosure.

As shown in FIGS. 4A and 4B, the left utility cabinet 200 may include a pull-out changing compartment 210 in a top portion of the cabinet 200. The changing compartment 210 may include two side panels 211, 212 and a bottom panel 215. The two side panels 211, 212 may be attached to a front panel 213 and a back panel 214 with dowel pins and wood glue. In some implementations, the changing compartment 210 is sized for a standard changing pad, and may include one aspect where the front panel 213 has a width of about 16 inches. The changing compartment 210 can be installed in the left utility cabinet 200 with drawer glides (not shown). In other implementations, the changing compartment 210 may use a fold-out construction.

Figure 4C:
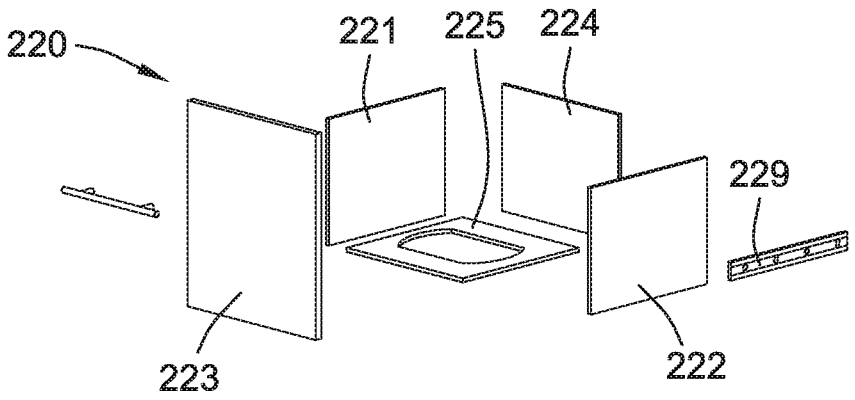
FIG. 4C is an exemplary exploded partial view of a diaper disposal compartment of the first utility cabinet of FIG. 4A, according to some aspects of the present disclosure.

The left utility cabinet 200 further may include a pull-out diaper disposal compartment 220 in a bottom portion of the cabinet 200, as further illustrated in FIG. 4C. The diaper disposal compartment 220 may include two side panels 221, 222. The two side panels 221, 222 may be attached to a front panel 223 and a back panel 224 with dowel pins and wood glue. In some implementations, the diaper disposal compartment 220 includes a holder slot 225 for securing a standard sized diaper disposal unit (such as a Diaper Genie®). The diaper disposal compartment 220 may be affixed on the left utility cabinet 200 with drawer glides 229. In some preferred implementations, the diaper disposal compartment 220 and the changing compartment 210 are designed to be on the same side (for example, both in the left utility cabinet 200) to prevent contamination to a bottle maker compartment 310 located in a separate utility cabinet, such as right utility cabinet 300, which will be discussed below in more detail.

The left utility cabinet 200 may also include a plurality of removable or fixed wheels 280 for easy transportation, similar to wheels 180 described for the center cabinet assembly 100. The wheels 280 may be attached to the left utility cabinet 200 and be capable of locking into position such that the left utility cabinet cannot be moved or rolled on the supporting floor surface. Decorative trim 290 can be added to the top portion and the base portion of the left utility cabinet 200 with solid fasteners. In some implementations, the style of the plurality of decorative trim 290 of left utility cabinet 200 matches that of the plurality of decorative trim 190 of the center cabinet assembly 100.

Figure 5A:
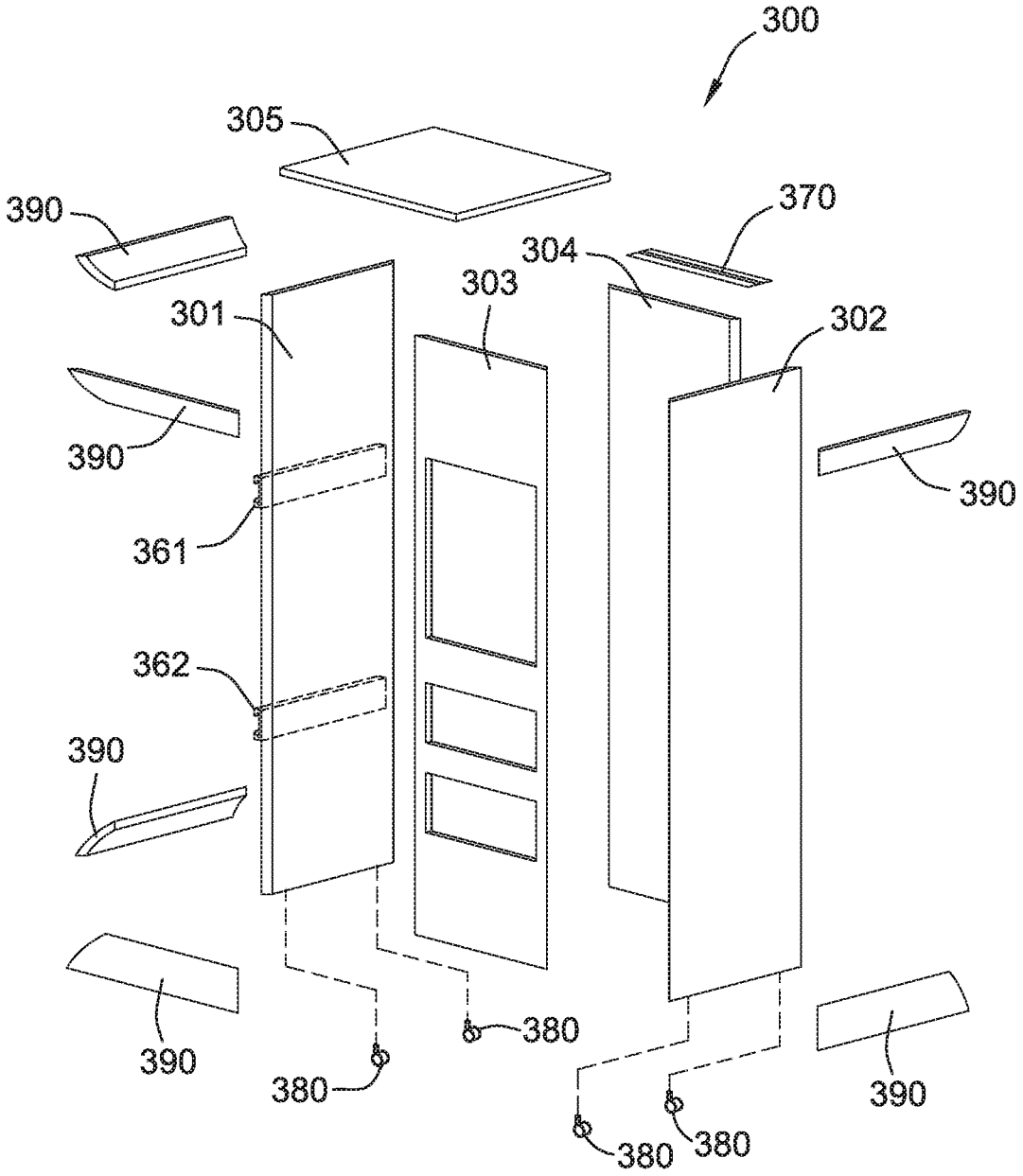
FIG. 5A is an exemplary exploded partial view of a second utility cabinet of the compact baby care system of FIG. 1A, according to some aspects of the present disclosure.

In some aspects with a second utility cabinet, a similar arrangement to the first pair of interlocking brackets 161, 162 and the respective channels 261, 262 can be made on the opposite right side panel of the crib and dresser unit of the center cabinet assembly 100. For example, a second pair of interlocking brackets (not shown) on the right side panel 102 of the assembly 100 can be used to engage a respective pair of channels 361, 362 on a left side panel 301 of the exemplary right utility cabinet 300 that is illustrated in FIG. 5A. The channels 361, 362 may be at least partially recessed below a surface of the side panel 201 that is exposed to the outside surface of the right side panel 102. In other aspects, the channels 361, 362 may be surface mounted. The channels 361, 362 can expand across an entire width of the left side panel 301 such as from one edge to an opposing edge. Alternatively, the channels 361, 362 may only expand across a portion of the width of the left side panel 301. In some implementations, the interlocking brackets may be formed on the left side panel 301 of the right utility cabinet 300, and the respective pair of channels may be formed on the right side panel 102 of the crib and dresser unit of the center cabinet assembly 100. Other connection techniques may be used in place of the interlocking system described above. For example, the right side panel 102 of the crib and dresser unit and the left side panel 301 of the right utility cabinet 300 may be mechanically joined at their interfaces by dowel and/or tongue and groove construction techniques, or any other mechanical systems for joining units of furniture, such as techniques utilizing fasteners, supports, glides, slides, and channels. Once joined or connected, the panels 102, 301 are flush with each other.

Figure 5B:
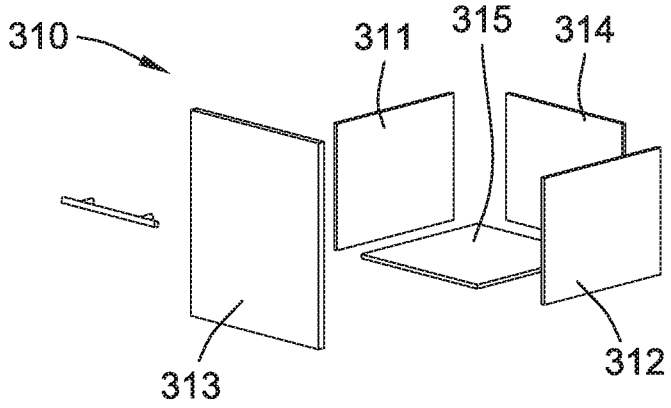
FIG. 5B is an exemplary exploded partial view of a bottle maker compartment of the second utility cabinet of FIG. 5A, according to some aspects of the present disclosure.

In some exemplary implementations, the right utility cabinet 300 also may include a right side panel 302, a front panel 303, a back panel 304, and a top panel 305. The panels may be attached to the right utility cabinet 300 with dowel pins and wood glue. Alternatively, the top panel 305 may be modified to include a hinge assembly 370 where the top panel 305 operates as a lid that opens up, allowing additional storage space similar to space 275 or to allow access to through the top of the right utility cabinet. The right utility cabinet 300 may include a pull-out bottle maker compartment 310 illustrated in FIG. 5B that is located in the top portion of cabinet 300. The bottle maker compartment 310 may include two side panels 311, 312 and a bottom panel 315. The side panels 311, 312 may be attached to a front panel 313 and a back panel 314 with dowel pins and wood glue. In an exemplary implementation, the bottle maker compartment 310 is sized to fit a standard baby bottle maker. In some aspects the front panel 313 has a width of about nine inches.

Figure 5C:
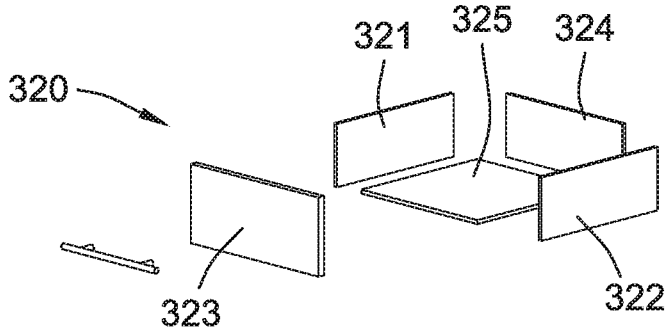
FIG. 5C is an exemplary exploded partial view of a sliding utility drawer of the second utility cabinet of FIG. 5A.
Figure 5D:
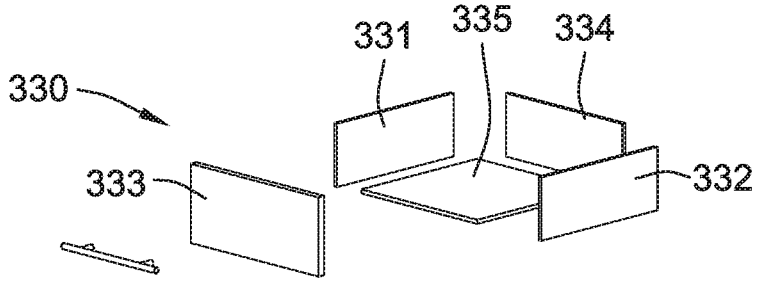
FIG. 5D is an exemplary exploded partial view of another sliding utility drawer of the second utility cabinet of FIG. 5A, according to some aspects of the present disclosure.

The right utility cabinet 300 may also include one or more sliding utility drawers, e.g., 320, 330 in FIGS. 5C and 5D, in the bottom portion of the cabinet 300. One utility drawer 320 may include two side panels 321, 322 and a bottom panel 325. The side panels 321, 322 may be attached to a front panel 323 and a back panel 324 with dowel pins and wood glue. The utility drawer 320 may be affixed to the right utility cabinet 300 with drawer guides, similar to drawer 130. Another utility drawer 330 is also contemplated, where like reference numbers 331, 332, 333, 334, 335 are used for like elements 321, 322, 323, 324, 325. In one exemplary implementation, each of the front panels 323, 333 of the utility drawers 320, 330 have a width of about nine inches.

The right utility cabinet 300 may also include a plurality of removable or fixed wheels 380 for easy transportation, similar to wheels 180, 280 described for the center cabinet assembly 100 and the right utility cabinet 200. The wheels 380 may be attached to the right utility cabinet 300 and be capable of locking into position such that the right utility cabinet 300 cannot be moved or rolled on the supporting floor surface. Decorative trim 390 can be added to the top portion and the base portion of the right utility cabinet 300 with solid fasteners. In some implementations, the style of the plurality of decorative trim 390 of left utility cabinet 300 matches that of the plurality of decorative trim 190, 290 of the center cabinet assembly 100 and the left utility cabinet 200.

Referring back to FIG. 1A, the compact baby care system 10 has a width, W1, measured horizontally from the left side panel 201 of the left utility cabinet 200 to the right side panel 303 of the right utility cabinet 300. The width, W1, is measured along the horizontal direction perpendicular to the left side panel 201 of the left utility cabinet 200 and the right side panel 303 of the right utility cabinet 300. The left utility cabinet 200 has a width, W2, measured horizontally from the left side panel 201 to the right side panel 202. The width, W2, is measured along the horizontal direction perpendicular to the left side panel 201 and the right side panel 202. The center cabinet assembly 100 has a width, W3, measured horizontally from the left side panel 101 to the right side panel 102. The width, W3, is measured along a horizontal direction perpendicular to the left side panel 101 and the right side panel 102. The right utility cabinet 300 has a width, W4, measured horizontally from the left side panel 301 to the right side panel 302. The width, W4, is measured along a horizontal direction perpendicular to the left side panel 301 and the right side panel 302. In addition, the compact baby care system 10 has a vertical height, H, measured along the vertical direction parallel to the side panels 101, 102, 201, 202, 301, 302.

In some implementations of the present disclosure, the center cabinet assembly 100, the left utility cabinet 200, and the right utility cabinet 300 are packaged or shipped separately as individual units for easy transportation. Once those individual units arrive their destination, they can be assembled into the compact baby care system 10. It is also noted that in some aspect the baby care system 10 is considered compact based on the baby care system meeting certain dimensions. For example, in one aspect of the present disclosure, a ratio of the combined width, W2 plus W3, of the left utility cabinet 200 and the center cabinet assembly 100 to the width, W3, of the center cabinet assembly 100 alone is between about 1.2 to about 1.6. In another aspect of the present disclosure, a ratio of the combined width, W3 plus W4, of the center cabinet assembly 100 and the right utility cabinet 300 to the width W3 of the center cabinet assembly 100 alone is between about 1.0 to about 1.5. In another aspect of the present disclosure, a ratio of the width, W1, of the compact baby care system 10 to the width, W3, of the center cabinet assembly 100 is between about 1.5 to about 2. In another aspect of the present disclosure, a ratio of the width, W1, of the compact baby care system 10 to the height, H, of the compact baby care system 10 is between about 1.6 to about 2.

In one exemplary aspect, the width, W1, of the compact baby care system 10 has a preferred maximum dimension of about 86 inches. In another exemplary aspect, the width, W2, of the left utility cabinet 200 has a preferred maximum dimension of about 20 inches. In another exemplary aspect, the width, W3, of the center cabinet assembly 100 has a preferred maximum dimension of about 52 inches. In another exemplary aspect, the width, W4, of the right utility cabinet 300 has a preferred maximum dimension of about 14 inches. In yet another exemplary aspect, the height, H, of the compact baby care system 10 has a preferred maximum dimension of about 48 inches.

While the present disclosure has been described with reference to one or more particular implementations, those skilled in the art will recognize that many changes may be made thereto without departing from the spirit and scope of the present disclosure. Each of these implementations and obvious variations thereof is contemplated as falling within the spirit and scope of the present disclosure, which is set forth in the claims that follow.

What is claimed is:

1. A compact multi-component baby care system comprising:

a baby crib assembly including a left side panel, an opposing right side panel, a bottom panel, and opposing top and bottom horizontal rails extending between the left side panel and the opposing right side panel, wherein the bottom panel is horizontally secured between the left side panel and the opposing right side panel, the bottom panel configured to support a mattress, the opposing top and bottom horizontal rails having a plurality of horizontally spaced vertical slats extending from at least one top horizontal rail to at least one respective bottom horizontal rail;

at least one sliding storage drawer underneath the bottom panel of the baby crib assembly;

a first utility cabinet coupled to the left side panel, the first utility cabinet including a baby changing station and a storage compartment, the baby changing station supporting a baby changing pad, the storage compartment including a top panel hinged to move upward from the baby changing station; and a second utility cabinet coupled to the opposing right side panel, the second utility cabinet including a baby feeding station storing a bottle maker, wherein the baby changing station and the baby feeding station are positioned on opposing sides of the baby crib assembly, thereby preventing contamination from the baby changing station to the baby feeding station.

2. The compact multi-component baby care system of claim 1, wherein a ratio of a combined maximum width of the baby crib assembly and at least one of the first utility cabinet and the second utility cabinet to a maximum width of the baby crib assembly alone is between about 1.2 to about 2, wherein the maximum widths are defined by (i) the distances between the respective left and right side panels of the first utility cabinet, the second utility cabinet, and the baby crib assembly and (ii) along a horizontal direction perpendicular to the left and right side panels.

3. The compact multi-component baby care system of claim 1, wherein the left side panel of the baby crib assembly is a first shared side panel with the first utility cabinet, and wherein the opposing right side panel of the baby crib assembly is a second shared side panel with the second utility cabinet.

4. The compact multi-component baby care system of claim 1, wherein the baby changing station includes a first sliding utility compartment configured to slide in a direction parallel to a plane defined by the left side panel.

5. The compact multi-component baby care system of claim 4, wherein the first sliding utility compartment supports the baby changing pad.

6. The compact multi-component baby care system of claim 4, wherein the baby changing station of the first utility cabinet includes a second sliding utility compartment configured to support a diaper disposal unit.

7. The compact multi-component baby care system of claim 6, wherein the second sliding utility compartment is configured to slide in a direction parallel to the first sliding utility compartment.

8. The compact multi-component baby care system of claim 4, wherein the baby changing station includes a second sliding utility compartment storing the bottle maker, and wherein the second sliding utility compartment is configured to slide in a direction parallel to the first sliding utility compartment.

9. The compact multi-component baby care system of claim 8, wherein the second utility cabinet further includes a storage compartment having a top panel hinged to move upward from the baby feeding station.

10. The compact multi-component baby care system of claim 1, wherein a ratio of a combined maximum width of the first utility cabinet, the second utility cabinet, and the baby crib assembly to a maximum width of the baby crib assembly alone is between about 1.5 to about 2, wherein the maximum widths are defined by (i) the distances between the respective left and right side panels of the first utility cabinet, the second utility cabinet, and the baby crib assembly, and (ii) along a horizontal direction perpendicular to the left and right side panels.

11. The compact multi-component baby care system of claim 1, further comprising a connector configured to couple the second utility cabinet to the right side panel, the connector including:

a first connecting component extending from a surface of a side panel of the second utility cabinet; and a second connecting component formed in the opposing right side panel of the baby crib assembly for receiving the first connecting component, such that engagement between the first connecting component and the second connecting component allows a flush connection between the right side panel of the baby crib assembly and the side panel of the second utility cabinet.

12. A method of assembling a compact multi-component baby care system, the method comprising:

providing a compact multi-component baby care system kit including:

a combined baby crib and dresser unit, the combined baby crib and dresser unit including opposing side panels and a plurality of wheels, a first panel of the opposing side panels supporting a first portion of a first connector, a second panel of the opposing side panels supporting a first portion of a second connector, a baby changing utility cabinet including a first utility side panel and a plurality of wheels, the first utility side panel supporting a second portion of the first connector, the baby changing utility cabinet including (i) a sliding changing table supporting a baby changing pad and (ii) a first storage compartment below the sliding changing table, the first storage compartment storing a diaper disposal unit, and a baby feeding utility cabinet including a second utility side panel and a plurality of wheels, the second utility side panel supporting a second portion of the second connector, the baby feeding utility cabinet including a bottle making compartment and a second storage compartment, the bottle making compartment being configured to extend in a direction parallel to a plane defined by the second utility side panel, the bottle making compartment storing a bottle maker, the second storage compartment including a top panel hinged to move upward from the bottle making compartment, wherein the baby changing utility cabinet and the baby feeding utility cabinet are configured to couple to opposite sides of the combined baby crib and dresser unit, thereby preventing contamination from the baby changing utility cabinet to the baby feeding utility cabinet;

connecting the baby changing utility cabinet to the combined baby crib and dresser unit via the first and second portions of the first connector; and connecting the baby feeding utility cabinet to the combined baby crib and dresser unit via the first and second portions of the second connector.

13. The method of claim 12, wherein one or more of the plurality of wheels for the combined baby crib and dresser unit, the baby changing utility cabinet and the baby feeding utility cabinet are locking wheels, and wherein the method further includes securing at least one of the plurality of wheels into a locked position.

14. The method of claim 12, wherein each of the first portions of the first and second connectors is an elongated tongue, and wherein each of the second portions of the first and second connectors is an elongated groove.

15. The method of claim 12, wherein each of the first portions of the first and second connectors is an interlocking bracket, and wherein each of the second portions of the first and second connectors is an elongated channel.

16. The method of claim 12, wherein each of the first portions of the first and second connectors is an elongated groove, and wherein each of the second portions of the first and second connectors is an elongated tongue.

17. The method of claim 12, wherein each of the first portions of the first and second connectors is an elongated channel, and wherein each of the second portions of the first and second connectors is an interlocking bracket.

18. The method of claim 12, wherein the sliding changing table and the first storage compartment are configured to slide in a direction parallel to a plane defined by the first utility side panel.

19. The method of claim 12, wherein a ratio of a maximum width of the connected compact multi-component baby care system kit and a maximum width of the combined baby crib and dresser unit is between about 1.2 to about 2, and wherein the maximum widths are defined by (i) the distance between a second utility side panel opposing the first utility side panel of the baby changing utility cabinet and a second utility side panel opposing the first utility side panel of the baby feeding utility cabinet, (ii) the distance between the opposing side panels of the combined baby crib and dresser unit, and (iii) along a horizontal direction perpendicular to the opposing side panels of the combined baby crib and dresser unit.

20. A compact multi-component baby care system comprising:

a baby crib assembly including a left side panel, an opposing right side panel, a bottom panel, and opposing top and bottom horizontal rails extending between the left side panel and the opposing right side panel, wherein the bottom panel is horizontally secured between the left side panel and the opposing right side panel, the bottom panel configured to support a mattress, the opposing top and bottom horizontal rails having a plurality of horizontally spaced vertical slats extending from at least one top horizontal rail to at least one respective bottom horizontal rail;

at least one sliding storage drawer underneath the bottom panel of the baby crib assembly;

a first utility cabinet coupled to the left side panel, the first utility cabinet including a baby changing station and a storage compartment, the baby changing station including:

a first sliding utility compartment supporting a baby changing pad and configured to slide in a direction parallel to a plane defined by the left side panel; and a second sliding utility compartment supporting a diaper disposal unit, the second sliding utility compartment positioned beneath the first sliding utility compartment and configured to slide in the same direction as the first sliding utility compartment; and a second utility cabinet coupled to the opposing right side panel, the second utility cabinet including a baby feeding station, the baby feeding station including a third sliding utility compartment supporting a bottle maker and configured to slide in the same direction as the first sliding utility compartment, wherein the baby changing station and the baby feeding station are positioned on opposing sides of the baby crib assembly, thereby preventing contamination from the baby changing station to the baby feeding station.

* * * * *